United States Patent [19]

Hanneman

[11] 3,997,059

[45] Dec. 14, 1976

[54] ROTARY GARMENT CLOSET

[76] Inventor: David D. Hanneman, 701 State St., Petoskey, Mich. 49770

[22] Filed: Oct. 1, 1975

[21] Appl. No.: 618,465

[52] U.S. Cl. ..... 211/1.5; 52/31; 312/305

[51] Int. Cl.[2] ..... A47F 3/08

[58] Field of Search ..... 211/1.5, 40, 113, 95, 211/115; 52/29, 31; 312/133–135, 266–269, 326, 305

[56] References Cited

UNITED STATES PATENTS

| | | | |
|---|---|---|---|
| 321,624 | 7/1885 | McPherson | 211/115 X |
| 953,205 | 3/1910 | Hughes | 312/135 X |
| 1,435,856 | 11/1922 | Kelly | 108/20 X |
| 2,635,764 | 4/1953 | Mattocks | 312/133 X |
| 2,967,081 | 1/1961 | Kleinpenning | 211/1.5 X |
| 3,144,133 | 8/1964 | Poulos | 211/1.5 |
| 3,207,316 | 9/1965 | Egger | 211/1.5 |
| 3,339,744 | 9/1967 | Ginsberg | 211/115 X |

*Primary Examiner*—Roy D. Frazier
*Assistant Examiner*—Terrell P. Lewis
*Attorney, Agent, or Firm*—Robert B. Gerhardt

[57] ABSTRACT

A garment device for installation in a clothes closet has a drive and support assembly located between joints above the closet ceiling, the assembly including a switch controlled electric motor, a gear reduction box, a drive shaft rotatably carried in a sleeve member attached to the assembly. The assembly also includes a thrust bearing to support the shaft. The shaft extends through the ceiling into the closet and has a circular garment rack comprising a circular notched member for receiving garment hangers connected by spokes to a hub mounted on the end of the shaft. A rotatable shelf may also be attached to the shaft above the garment rack.

2 Claims, 4 Drawing Figures

ROTARY GARMENT CLOSET

The present invention relates to a device for storing garments and other items and more particularly to a rotary device permanently installed in a residential clothes closet.

Conventional clothes or garment closets are elongated in shape in order to accommodate a sufficient number of garments on an elongated hanging rod for the person or persons using the closet. A typical home closet is about 7 feet wide and 2½ feet deep. In order to both shut off and gain access to the closet, an expensive folding door at least 6 feet wide is required. Thus, 6 feet of wall space is used. In addition, this type closet can not be accessed from different rooms such as an adjoining bathroom. These closets require an excess use of building material since they are generally of irregular size, that is, not in units of 4 feet.

There has been previously proposed the use of circular rotatable garment racks. These racks can be inserted in a closet and can be rotated to bring garments on the circular rack to a position in front where they are accessible to the user.

These last mentioned proposals, while suggesting improvements over conventional closets have not found acceptance. For one reason, they are usually intended to be installed in existing closets rather than in new home constructions. In order to support the considerable weight of garments these racks normally extend between the floor and ceiling and are supported on the floor, such support hindering access to the rear of the closet floor. The present invention has for an object the provision of a rotary garment holding rack that is intended to be installed in closets during initial construction of the building containing the closet.

A further object is to provide such a garment holding rack that is supported from above the closet ceiling and extends through the ceiling down into the closet interior.

Still another object is to provide a garment rack in a closet that is power operated to bring the garments to a position accessible to the user.

These and other objects and advantages will be readily apparent from the following specification and accompanying drawings in which.

Figure 1:
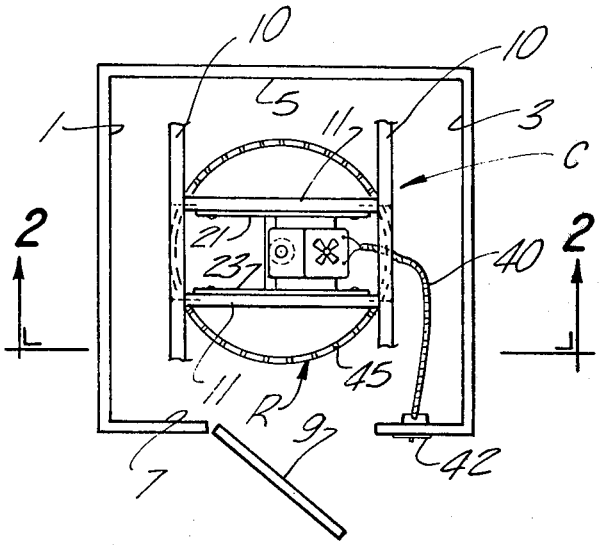
FIG. 1 is a top view of a closet and garment rack combination with the closet ceiling removed to show the interior of the closet.

The invention, in its preferred form, is shown applied to a closet construction including side walls 1 and 3, a back wall 5, front wall 7 and a door 9. The closet has a ceiling 13 supported by and fastened to conventional rafters 10. The interior of the closet is designated C.

Figure 2:
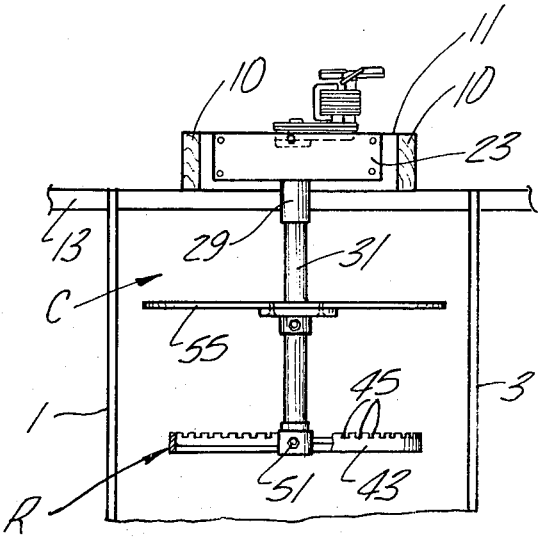
FIG. 2 is an elevational view of the closet of FIG. 1.
Figure 3:
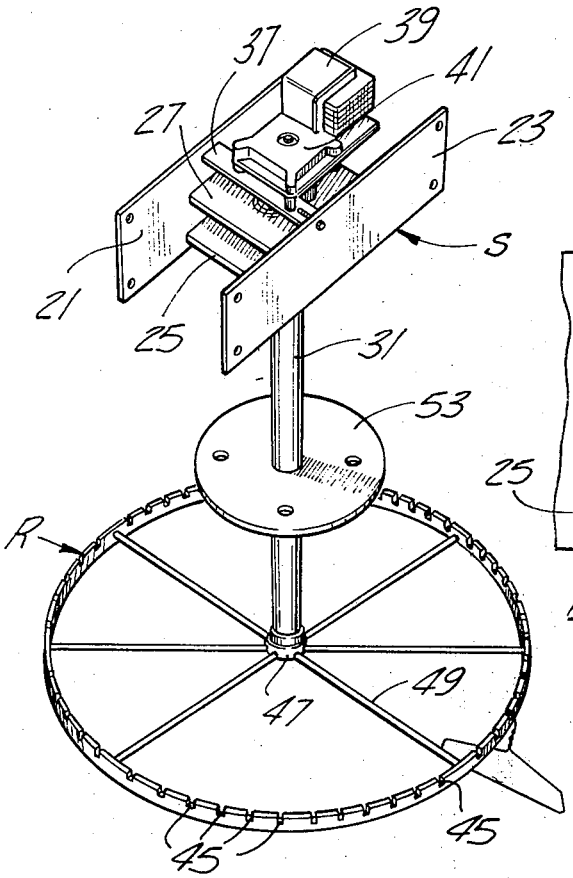
FIG. 3 is a perspective view of the garment rack shown assembled as it would be in place in a closet.
Figure 4:
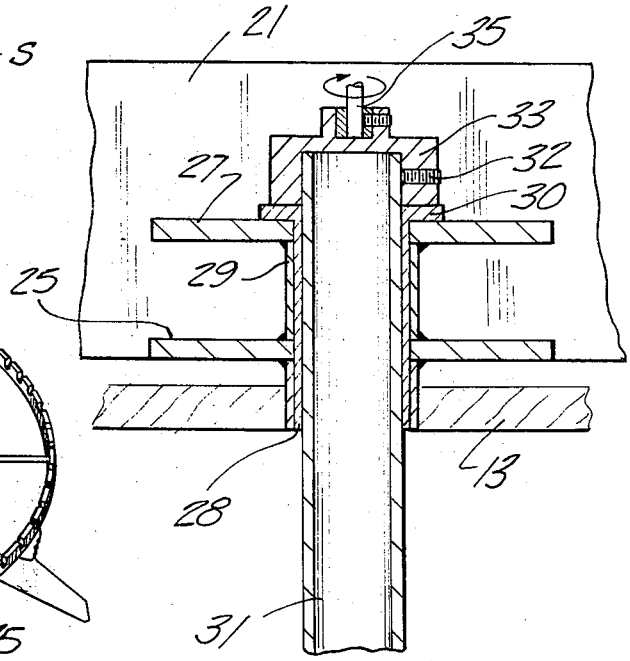
FIG. 4 is a sectional enlarged view of the garment rack supporting construction.

As seen in FIGS. 2 and 3 there is provided a combined drive and support assembly generally indicated S. The assembly S includes a pair of laterally spaced parallel frame members 21 and 23. The frame members 21 and 23 are connected by two additional cross frame members 25 and 27. Secured by welding or by other means to the members 21 and 23. As best seen in FIG. 4, a sleeve bearing member 29 having an internal bushing 28 extends through apertures formed in the cross members 25 and 27. The sleeve 29 is welded or otherwise secured to the cross member 25 and 27. The bushing 28 has a radially extending flange portion 30 formed at the upper end thereof. The side frame members 21 and 23 have pre-drilled holes for attaching the frame members to cross joists 11 attached to the rafters 10 as shown in FIG. 1.

A hollow garment support shaft 31 extends as shown in FIG. 4 through the bushing 28. The bushing 28, sleeve 29 and shaft 31 together extend through a hole in the ceiling 13 into the closet interior C. A cap like member 33 fits over the upper end of the shaft 31. The lower end of the cap member 33 forms a bearing surface that contacts the upper surface portion of the flange 30, the two surfaces forming a thrust bearing that carries the weight of the shaft 31 while it rotates.

The cap 33 is secured to the shaft 31 by suitable means such as a set screw 32 carried by the cap 33 and extending into an aperture in the shaft 31. The top of the cap has a recess for receiving a drive shaft 35 that extends from a gear box 40 carried on a cross member 37 located between the side frame members 21 and 23. The gear box 40 contains speed reducing gears that interconnect the drive shaft 35 and the output shaft of an electric motor 39.

The electric drive motor 39 is controlled by a switch 42 mounted in the front wall 7 of the closet. The switch 42 is connected to a source of electricity not shown.

At the bottom of the shaft 31 extending into the closet there is attached a garment holding rack generally indicated R. The rack R includes a hub member 47 out of which a plurality of spoke members 49 extend. The hub 47 is attached to the shaft 31 by any suitable means such as a set screw 51. The outer ends of spokes 49 are attached to the inner side of a circular garment hanger member 43. The circular member 43 has a plurality of circumferentially spaced notches 45 for receiving the hanging hooks of garments hangers such as hanger 46 in FIG. 3. The notches 46 are square to ensure that the hooks do not easily come out of the notches.

A shelf 55 can be carried on a bracket member 53 that can be axially moved up and down on the shaft 31, and axially and rotatably secured to the shaft by a set screw 54. If desired several shelves can be carried on the shaft.

The circular garment rack provides a hanging rod that will hold a number of garments equal to the circumference of the rack. For example, 4 foot square closet can hold more than the garments normally contained in a 7 foot long closet. The notches 45 keep the hangers separated and prevent entanglement of the same. When the user wishes to select a particular garment, he merely switches on the motor by means of switch 42 and when the selected garment has been rotated on the rack to the front, the switch is released and the rack stops rotating. If a shelf is also provided, articles thereon can be brought into reach.

The invention can be applied to existing closets but is particularly application to new construction. Changes and modifications may be made by those skilled in the art and such changes are deemed to be within the scope of the invention which is limited only by the following claims:

I claim:

1. A rotary garment rack adapted to be installed in a closet comprising a combination drive and support assembly adapted to be located above the closet ceiling and having attaching means for supporting the assembly on joists above the closet ceiling, said attaching means including a pair of laterally spaced frame members and a cross member carried by and secured to said frame members, said assembly further including an electric motor carried on the assembly, a shaft extending vertically downward from the assembly through the cross member, said shaft adapted to extend downward through the closet ceiling into the interior of the closet, bearing means carried by the assembly and rotatably supporting the shaft, said bearing means including a flange member attached to the top portion of said shaft and having a first downwardly facing radial surface and said cross member having a second upwardly facing surface, said surfaces cooperating to carry the weight of said shaft, a circular garment hanger member connected to the lower end of said shaft by means of a plurality of radially extending spoke members, means connecting said electric motor with said shaft to rotate the same.

2. The garment rack of claim 1 wherein said assembly includes a cap member having means securing it to the top of the shaft and the operative connection between the electric motor and the shaft includes a speed reducing gearing having an output shaft connected to said cap member.

* * * * *